US012559303B2

(12) United States Patent
Etheridge et al.

(10) Patent No.: US 12,559,303 B2
(45) **Date of Patent: *Feb. 24, 2026**

(54) COMPOSITE THIEF HATCH SYSTEMS

(71) Applicant: ENCINO ENVIRONMENTAL SERVICES, LLC, Alleyton, TX (US)

(72) Inventors: Joe Etheridge, Houston, TX (US); James Timmins, Alleyton, TX (US); Kris Kervick, Alleyton, TX (US)

(73) Assignee: ENCINO ENVIRONMENTAL SERVICES, LLC, Alleyton, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/777,006

(22) Filed: Jul. 18, 2024

(65) Prior Publication Data

US 2024/0367897 A1 Nov. 7, 2024

Related U.S. Application Data

(63) Continuation-in-part of application No. 18/107,722, filed on Feb. 9, 2023, now Pat. No. 12,049,355.

(60) Provisional application No. 63/308,286, filed on Feb. 9, 2022.

(51) Int. Cl.
*B65D 90/10* (2006.01)
*B65D 90/48* (2006.01)

(52) U.S. Cl.
CPC ..... *B65D 90/10* (2013.01); *B65D 90/48* (2013.01)

(58) Field of Classification Search
CPC ..... B65D 90/10; B65D 90/48; F13K 13/00
USPC ..... 220/203.23
See application file for complete search history.

(56) References Cited

U.S. PATENT DOCUMENTS

| | | | |
|---|---|---|---|
| 3,401,647 | A | 9/1968 | Ingram |
| 4,576,308 | A | 3/1986 | Sullivan |
| 5,353,944 | A | 10/1994 | Davis et al. |
| 5,660,295 | A | 8/1997 | Hroma |
| 6,085,664 | A | 7/2000 | Early |
| 6,095,365 | A | 8/2000 | Melding |
| 6,460,859 | B1 | 10/2002 | Hammi |
| 6,742,550 | B2 | 6/2004 | Caparros |
| 7,427,089 | B2 | 9/2008 | Silverio |
| 9,764,893 | B1 | 9/2017 | Westmoreland, III |

(Continued)

FOREIGN PATENT DOCUMENTS

| | | |
|---|---|---|
| CN | 101870815 B | 12/2011 |
| KR | 101013096 B1 | 2/2011 |

OTHER PUBLICATIONS

International Search Report and Written Opinion dated May 2, 2023 issued in PCT/US2023/12687.

(Continued)

*Primary Examiner* — Anthony D Stashick
*Assistant Examiner* — Raven Collins
(74) *Attorney, Agent, or Firm* — HUNTON ANDREWS KURTH LLP

(57) ABSTRACT

The present disclosure refers to a system and components for a thief hatch. The thief hatch may include a flange body comprising a first composite material. The flange is configured to attach to a tank roof. A lid is operably connected to the flange body. The lid comprises a second composite material. The lid comprises a hinge operably connected to allow for at least partial opening and closing of the lid. The first composite material and the second composite material are the same material or different materials.

21 Claims, 9 Drawing Sheets

(56) References Cited

U.S. PATENT DOCUMENTS

| | | | | |
|---|---|---|---|---|
| 2005/0191947 | A1 | 9/2005 | Chen et al. | |
| 2005/0199626 | A1 | 9/2005 | Gilbert et al. | |
| 2010/0044374 | A1 | 2/2010 | Thorwesten | |
| 2010/0125997 | A1 | 5/2010 | DePietro | |
| 2013/0264341 | A1 | 10/2013 | Cockerham et al. | |
| 2016/0001934 | A1 | 1/2016 | Craig | |
| 2016/0361983 | A1 | 12/2016 | Butz et al. | |
| 2019/0376601 | A1* | 12/2019 | Lehr | F16J 15/122 |
| 2021/0188538 | A1 | 6/2021 | Stroder | |

OTHER PUBLICATIONS

Fiberglass-Types, Properties, and Applications Across Industries' Phelps, Jul. 24, 2021, [From the Intranet] web.archive.org/web/20210724020519/https://www/phelpsgaskets.com/blog/fiberglass--types-properties-an-applications-across-industries>.

Product Brochure: Tank Management Catalog, Fisher, Flame & Detonation Arrestors (VCFLR-14153-EN) [From the Internet] (croftsupply.com), pp. 1-211, 2017.

Notification Concerning Transmittal of International Preliminary Report on Patentability from related PCT Application No. PCT/US2023/12687, mailed Aug. 6, 2024, 11 pages.

* cited by examiner

COMPOSITE THIEF HATCH SYSTEMS

CROSS-REFERENCE TO RELATED APPLICATIONS

The present application is a continuation-in-part application of U.S. patent application Ser. No. 18/107,722 filed on Feb. 9, 2023 which application claims priority to U.S. Provisional Application No. 63/308,286 filed Feb. 9, 2022, both of which applications are incorporated herein by reference in their entirety.

FIELD OF THE DISCLOSURE

The present disclosure relates to thief hatch systems used, for example, in covers or closures of low pressure holding tanks for fluids such as hydrocarbons, production fluids, byproducts of oil and gas, etc.

BACKGROUND AND SUMMARY

Throughout the oil and gas industry, atmospheric stock tanks are used to collect produced formation fluids, such as crude oil, natural gas condensate, and brine, at the surface for sales and/or disposal. Hatches are designed to remain closed to prevent fugitive emissions but occasional access may be required to, for example, gauge fluid levels within the tanks. Tank access is often controlled by what is known in the industry as a "thief hatch". Such hatches are typically a round or capsule-shaped flange with a hinged lid and a latch to keep the lid closed.

All produced fluids carry some amount of entrained hydrocarbon gases (i.e., methane) and/or volatile organic compounds (VOCs) into the stock tanks as a single phase. Therefore, if the hatch were to remain open, these volatile gases would eventually evolve (phase change) out of the fluid and vent to the atmosphere. Local, state, and federal regulations often limit the amount of such gases that may be emitted from a particular site. Thus, uncontrolled venting could potentially expose the operator to penalties in addition to presenting a personnel safety risk. Additionally, such gases are detrimental to air quality, human health, and are potent greenhouse gases (e.g., methane has a global warming potential (GWP) of 27 times that of carbon dioxide). Therefore, these hatches often have a sealing element such as a gasket that is designed to prevent gases from venting to atmosphere, except during over pressurization events, before they can be recovered and either recycled back into the product pipeline or destroyed by other means, such as a flare.

Unfortunately, the hatches and sealing elements are subject to failure. Such failures may be due to many different reasons. In some cases, failures may be due to dissimilar metals used in thief hatch construction which can cause various types of corrosion. Such corrosion may cause, for example, degradation of the gasket sealing (mechanical) interface. This may eventually lead to a partial or even an entire loss of seal integrity. This can result in the hatch venting hydrocarbon gases to the atmosphere even when it is properly closed and latched.

What is needed are new systems and components for thief hatches which do not substantially degrade or corrode. It would further be advantageous if such new systems and components did not substantially degrade or corrode even when exposed to, for example, weather, UV light, chemicals such as hydrocarbons and/or brine, Advantageously, the systems described herein may meet one or more up to all of the aforementioned needs.

The present disclosure refers to a system and components for a thief hatch. The thief hatch may comprise a flange body comprising a first composite material. The flange is configured to attach to a tank roof. A lid is operably connected to the flange body. The lid comprises a second composite material. The lid comprises a hinge operably connected to allow for at least partial opening and closing of the lid. The first composite material and the second composite material are the same material or different materials.

In another embodiment the thief hatch comprises a flange body comprising a first composite material. The flange is configured to attach to a tank roof. A lid is operably connected to the flange body. The lid comprises a second composite material and the lid comprises a hinge operably connected to allow for at least partial opening and closing of the lid. The first composite material and the second composite material may be the same material or different materials.

These and other features and advantages of the exemplary embodiments of the present disclosure will become apparent upon reading the following detailed description of the exemplary embodiments of the present disclosure, when taken in conjunction with the appended claims.

BRIEF DESCRIPTION OF THE DRAWINGS

Various embodiments of the present disclosure, together with further objects and advantages, may best be understood by reference to the following description taken in conjunction with the accompanying drawings.

Figure 1:
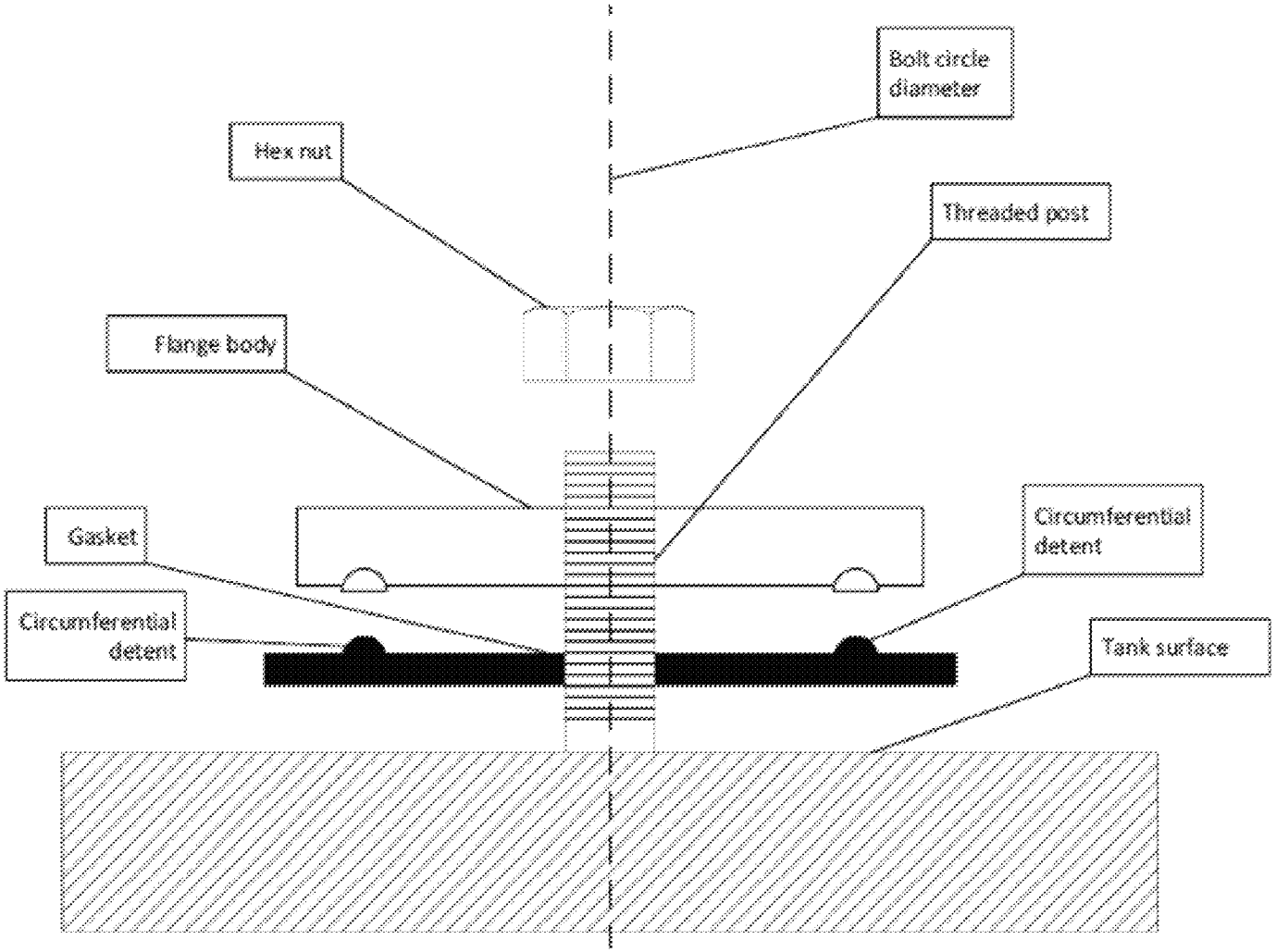
FIG. 1 shows a cross-sectional view of a circumferential detent.

DETAILED DESCRIPTION following description of embodiments provides non-limiting representative examples referencing numerals to particularly describe features and teachings of different aspects of the invention. The embodiments described should be recognized as capable of implementation separately, or in combination, with other embodiments from the description of the embodiments. A person of ordinary skill in the art reviewing the description of embodiments should be able to learn and understand the different described aspects of the invention. The description of embodiments should facilitate understanding of the invention to such an extent that other implementations, not specifically covered but within the knowledge of a person of skill in the art having read the description of embodiments, would be understood to be consistent with an application of the invention.

Thief Hatch

The thief hatch systems described herein generally comprise at least three components, e.g., a flange body, a closeable lid, and, if desired, a gasket. It should be understood that the gasket may be integral or separate from the flange body and/or closeable lid. The specific configurations, dimensions, and materials may differ depending upon the tank on which it is to be employed, the elements to which the components will be exposed, the type of materials to be stored in the tank, and other factors. In some embodiments at least some up to all the materials employed are comprised of an anti-static material to prevent sparks arising from static discharge.

Generally, the flange body and the lid are each comprised of a composite material. The composite material for each may be the same or different. The specific composite material is not particularly limited and is typically selected from composite materials that will not substantially corrode or degrade in the presence of weather, chemicals (e.g., hydrocarbons and/or brine), and/or ultraviolet rays. In some cases, the flange body, the lid, or both may comprise substantially no metal that would make the component susceptible to corrosion. This substantially removes the potential for accelerated oxidation, substantially retains seal integrity thereby reducing unwanted tank venting emissions over a longer period than, for example, cast metal options.

In some cases, the composite material for the lid, flange body or both may be a suitable polymer that does not substantially corrode or degrade in the presence of weather, chemicals (e.g., hydrocarbons and/or brine), and/or ultraviolet rays. Such polymer may include, for example, a thermoplastic, a thermoset, or a combination thereof. Such polymers include, for example, an acrylic, an ABS, a nylon, a PLA, a polybenzimidazole, a polycarbonate, a polyether sulfone, a polyoxymethylene, a polyether ether ketone, a polyetherimide, a polyethylene, a polyphenylene oxide, a polyphenylene sulfide, a polyphenylene sulfide (PPS), a polypropylene, a polystyrene, a polyvinyl chloride, a polyvinylidene fluoride, a polytetrafluoroethylene (Teflon), a polyester, a polyurethane, an epoxy resin, a polyimide, a silicon, a vinyl ester, or any combination thereof.

In some cases, it may be desirable to employ a fiber reinforced polymer for the flange body and/or lid. Such fiber reinforced polymers include, for example, one of the aforementioned polymers reinforced with glass (fiberglass), carbon, aramid, basalt, or any combination thereof. The amount of fiber in the reinforced polymer may vary and in some cases is from about 20% to about 40% by weight fiber based on the total weight of the polymer and glass. Particularly suitable composites include, for example, a polyetherimide reinforced with from about 20 to about 40% by weight glass such as the ULTEM™ line of resins available from SABIC, e.g., ULTEM™2300.

The flange body and lid are configured such that they may be attached to a storage tank in a manner which allows one to at least partially open and close the lid to inspect the interior of the tank and/or any sensors that may be employed within the tank. The specific type of attachment may vary depending upon the size of the tank, the desired size of the opening, the frequency of potential access required, chemicals in the tank, and other factors. Typically, the flange body is configured to attach to a tank roof. The lid may be operably connected to the flange body. The flange body may be attached to the roof of the tank in any convenient manner. In some embodiments the flange assembly may use an industry standard bolt pattern, for example, API 12F or ANSI 150.

A hinge may be operably connected to the lid such that it allows for at least a partial opening and closing of the lid for tank access when desired. The hinge is not particularly critical and may comprise a spring-loaded hinge mechanism made of composite, aluminum, or some combination thereof. In some embodiments, the hinge may be a pivoting type connection.

In various embodiments, a spring of a desired rating may be employed which can also act as an internal pressure relief device. The spring-actuated pressure relief mechanism may attach to the lid itself. The spring may be comprised of composite, aluminum, other suitable materials, or a combination thereof. This pressure relief mechanism may allow for positive and/or negative pressure (vacuum) relief. That is, a spring of a desired rating may be useful to relieve pressure at a predetermined setting which setting could be changed by a user by removing and reinstalling a spring of the desired rating. In various embodiments two springs may be used. These are pressure and vacuum relief springs and are coaxially housed in a hollow cylinder at the center of the internal assembly, which has an upset at the bottom against which one end the pressure spring abuts, while the other end is seated against the interior of the lid itself. The vacuum spring is conical whereas the pressure spring has a constant outer diameter (e.g., it may be cylindrical).

These springs are designated by the internal tank pressure (in oz/sq. in.) at which the spring pressure is overcome and the internal assembly (containing the vacuum relief spring and plate) begins to lift off the flange face. Similarly, negative pressure is relieved when tank pressure is reduced to a point that allows external pressure to overcome the spring force and allows the vacuum plate and gasket to lift off its flange surface.

A latch mechanism may be employed to keep the lid securely closed. The type of latch is not particularly limited so long as it secures the lid and prevents unwanted gases from escaping the tank. The latch may be comprised of the same composite described previously, aluminum, or some combination thereof.

If desired, a gasket may be employed between the flange body and the lid. The gasket may comprise any suitable material which material is preferably not subject to corrosion or degradation when operating in a hydrocarbon and/or other corrosive environment. In some embodiments the gasket comprises an elastomer configured such that the gasket is substantially concentric with the flange body. The gasket may be attached in a manner similar to the flange body. That is, the gasket may comprise bolt holes around the circumference using the same or similar pattern as the flange body attachment, e.g., an industry standard bolt pattern such as API 12F or ANSI 150. In this manner the same bolts may be used to secure both the flange body and gasket.

In some embodiments the gasket may comprise bolt holes around the circumference and/or the top of the gasket may comprise an outside circumferential detent and/or an inside circumferential detent. If employed, the outside circumferential detent and/or the inside circumferential detent may be configured to ensure substantial concentricity of the gasket with the flange body. That is, the elastomer gasket may comprise two semicircular and/or radiused circumferential detents (one inside and one outside the bolt circle diameter). The optional detents may provide additional gasket surface area without substantially increasing the gasket footprint, may increase a maximum pressure rating which may help to prevent fugitive emissions, and/or may assist in ensuring gasket concentricity with the flange body up to and throughout the life of the gasket material. This may assist in preventing one or more leaks as a material degrades due to, for example, exposure to elements and thus may possibly extend gasket service life.

The underside of the flange can have grooves to accept the detents on the gasket described above. In some embodiments, the underside of the flange may have an undulating seal surface having one or more grooves configured to reduce lateral movement of the gasket across said face. In various embodiments, the underside of the flange may have both types of grooves.

The thief hatch may comprise one or more sensors such as, for example, a thermometer, a volatile organic compound detector such as a methane detector, a lid closure sensor, or any combination thereof. Suitable lid closure sensors may include, for example, an inclinometer and/or an accelerometer configured to detect whether the hatch is open or closed. Another potential sensor may be employed that indicates whether the lid has been closed and/or latched properly. A boss may be configured to hold the one or more sensors. For example, a flat boss can be threaded to accept any of the aforementioned sensors in a sensor package to measure, record, and/or transmit conditions and/or operations within the vapor space of the tank or other enclosure associated with the thief hatch system. The one or more sensors employed may be configured to transmit (wired or wirelessly) data to a remote operator. In addition, a magnetic or infrared trip sensor and/or switch may be employed. One or more robots may be configured to take various actions based on the data from the sensors. For example, venting of one or more gases may be adjusted from the thief hatch based on sensor data.

The systems and components described herein may be manufactured in any convenient manner. For example, methods of manufacture may include Computer Numerical Control (CNC) machining, 3D printing, injection molding, or any other method by which the contemplated composite materials and components can be rendered into their desired shape.

FIG. 1 shows a cross-sectional view of a circumferential detent of a gasket mating with a corresponding circumferential detent of a flange body. While referred to as a circumferential detent it should be understood that the shape of the gasket and/or flange body and detent need not be limited to a circular shape. Any other desired shape may be employed. Similarly, while FIG. 1 shows a threaded post and hex nut other fasteners may be employed so long as they do not interfere with the desired sealing and non-corrosive nature of the system.

Figure 2:
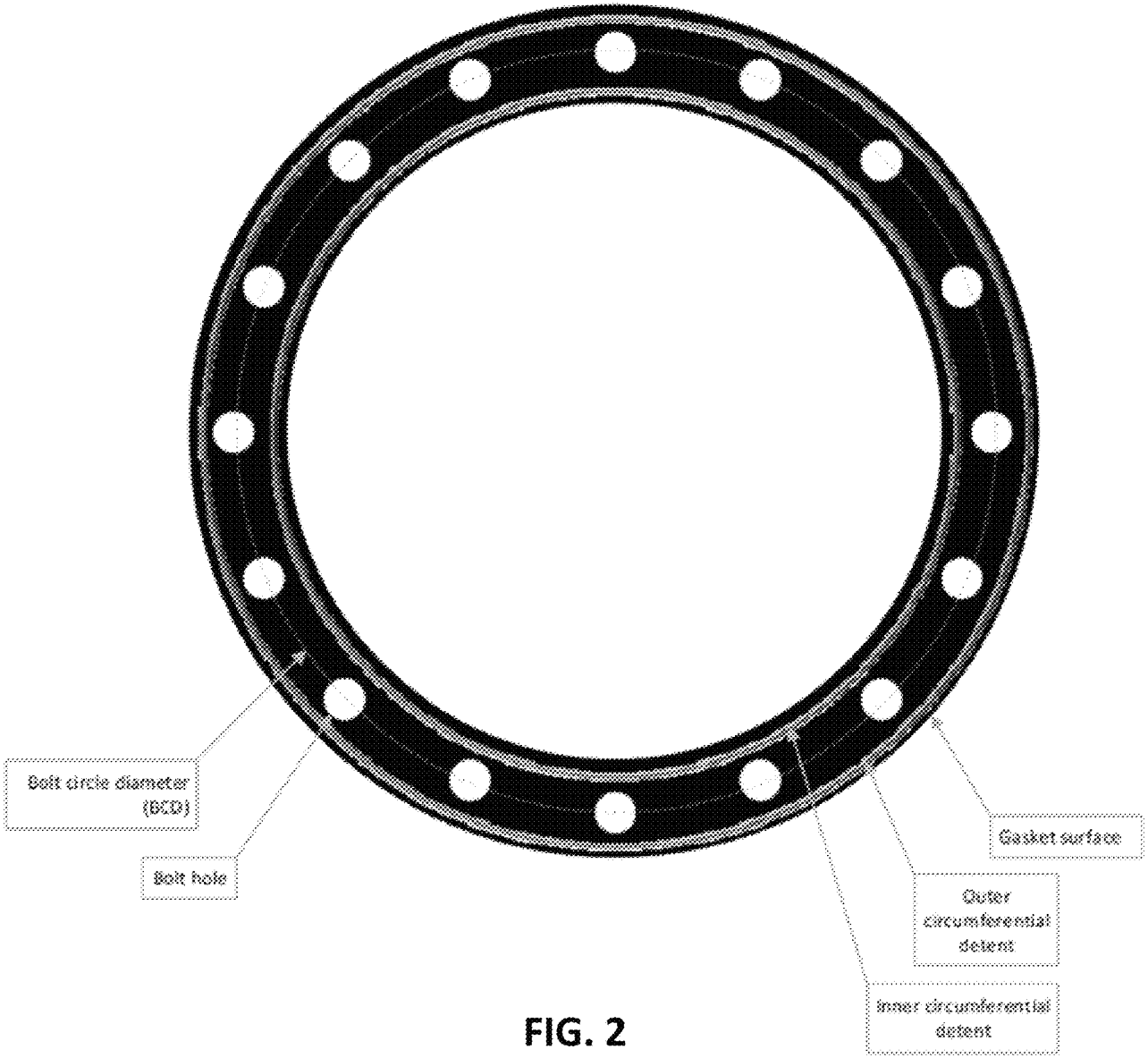
FIG. 2 shows a top view of a gasket showing an inner and an outer circumferential detents.

FIG. 2 shows a top view of a gasket showing the circumferential detents inside the bolt hole pattern (inner detent) and outside the bolt hole pattern (outer detent). While FIG. 2 shows a bolt circle diameter it should be understood that the bolt pattern is not limited to circular shaped just as the gasket, flange, and detent are not limited. The shape is not particularly critical so long as the proper seal is obtained.

Figure 3:
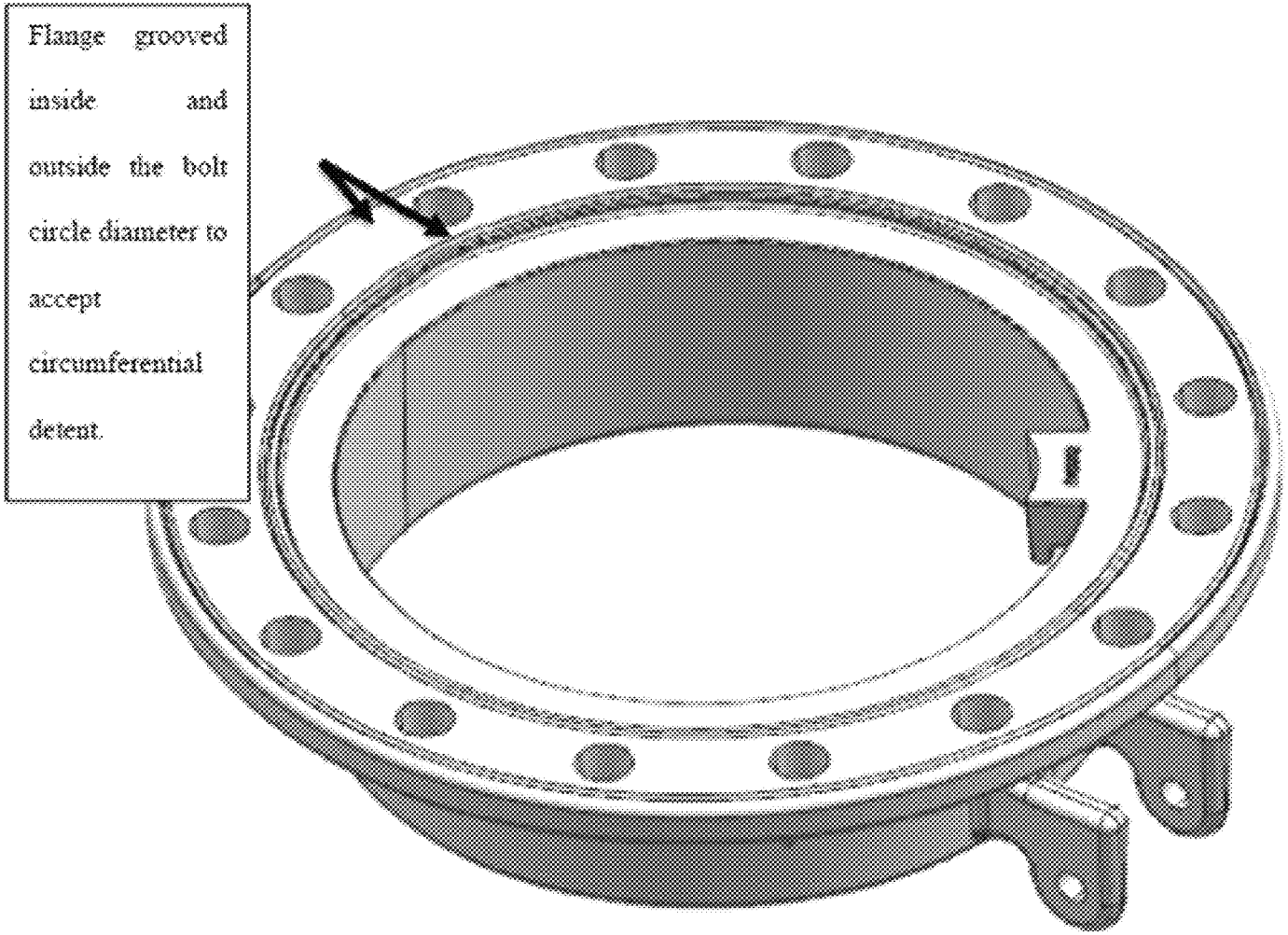
FIG. 3 shows an underside of a flange surface grooved to accept a circumferential detent.

FIG. 3 shows an underside of a flange surface grooved to accept a circumferential detent. The result is a hatch which, due to, for example, the novel material selection and configuration of components, retains its seal integrity (and therefore reduces unwanted tank venting emissions) over a longer period than the current cast metal options. The designs described herein are superior in sealing and less corrosive than even coated metals or added chemical resistant materials. The designs described herein in some embodiments replaces metal entirely thereby removing the potential for accelerated oxidation and unwanted venting.

Figure 4A:
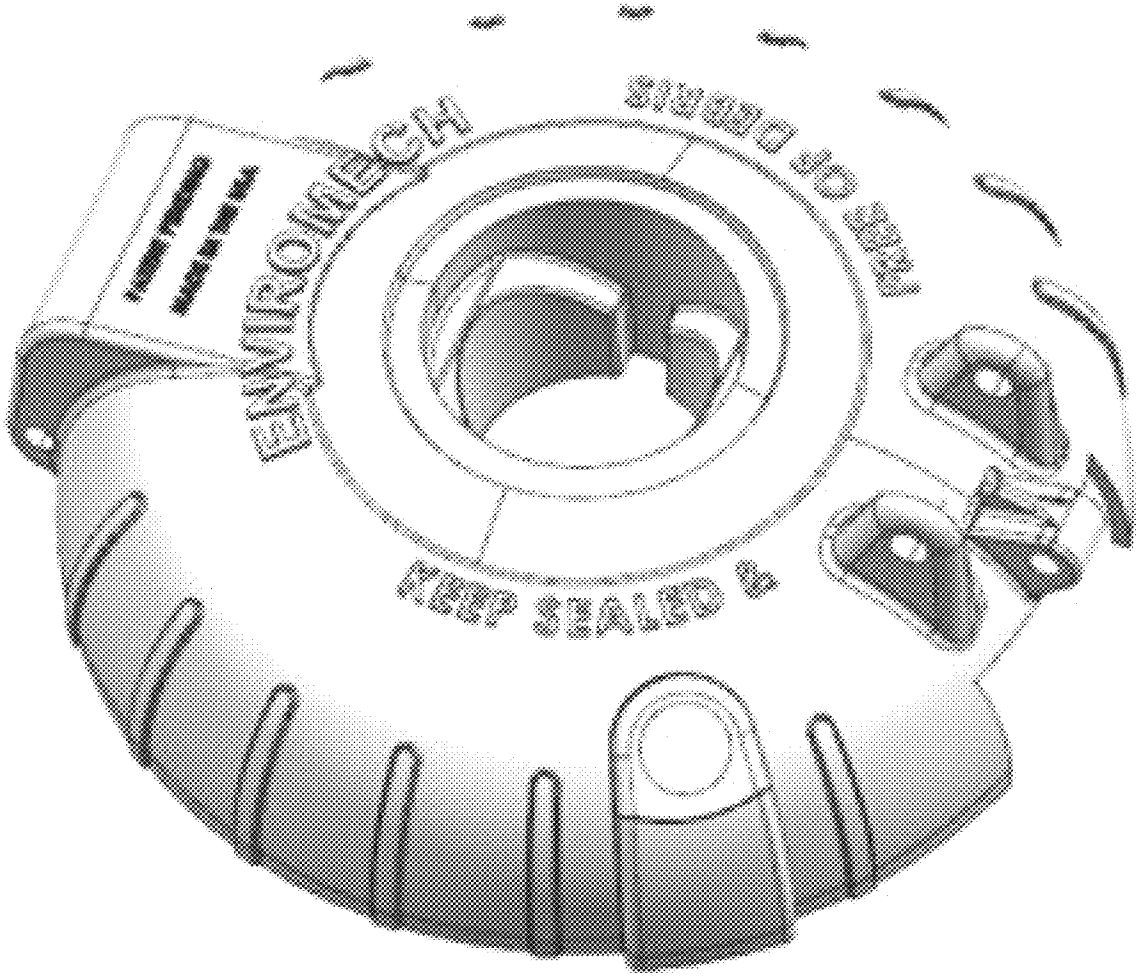
FIG. 4A shows a schematic top view of a representative thief hatch described herein.
Figure 4B:
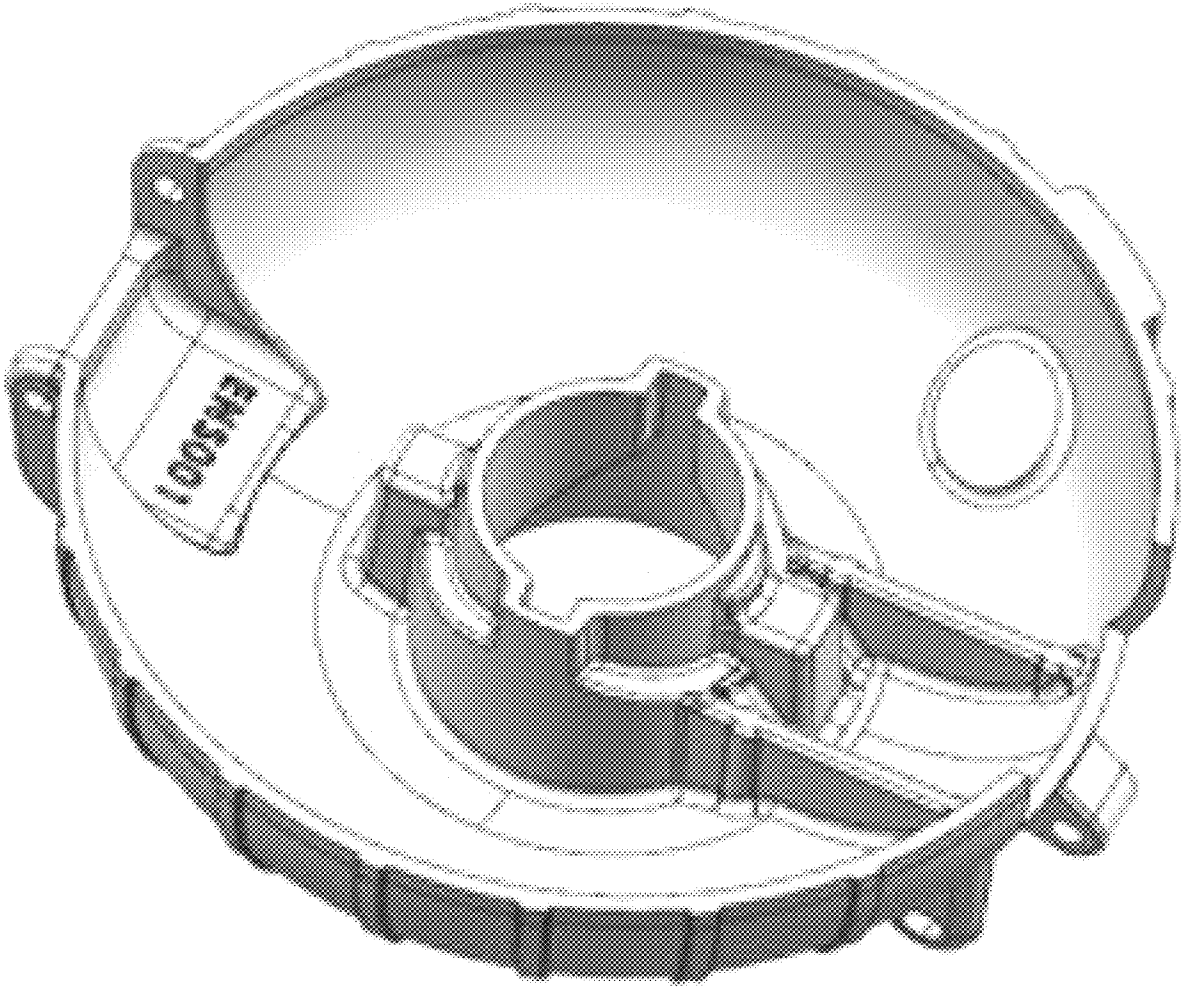
FIG. 4B shows a schematic bottom view of a representative thief hatch described herein wherein an instrument boss is shown on the bottom center.

FIG. 4A shows a schematic top view of a representative thief hatch described herein while FIG. 4B shows a schematic bottom view of a representative thief hatch described herein. As shown in FIG. 4B an instrument boss is shown on the bottom center.

Figure 5:
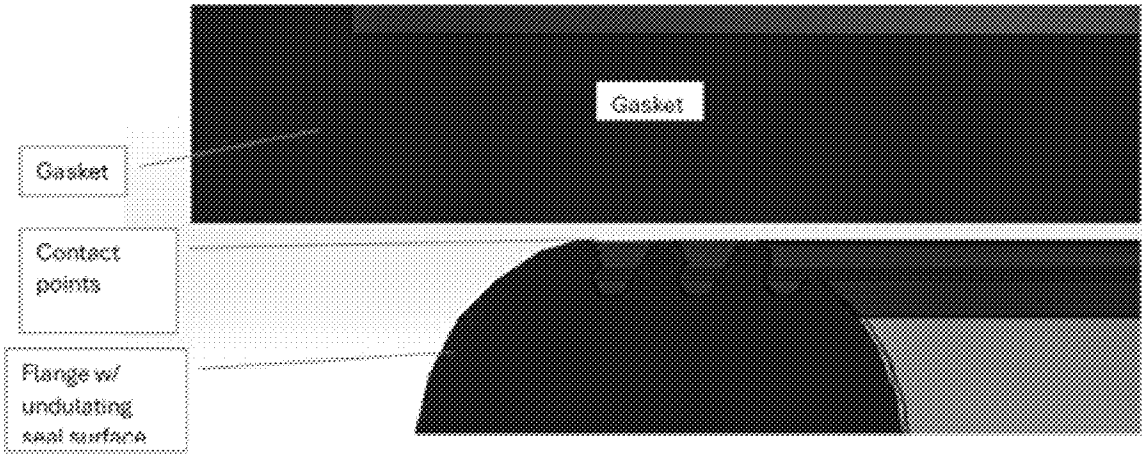
FIG. 5 shows a flange with an undulating seal surface.

FIG. 5 shows a flange with an undulating seal surface. The flange face that faces the gasket comprises one or more grooves configured to reduce lateral movement of the gasket across said face.

The number and geometry of the flange face grooves may vary depending upon the specific gasket, flange, and their respective materials and associated properties. In general, deeper grooves may be more appropriate for softer gasket compounds while shallower grooves may be more appropriate for harder gasket compounds. Other factors when considering the number and geometry of the grooves may include, for example, the abrasion or tear resistance that is desired with respect to how often one may replace or service a gasket on a given thief hatch system.

The manner of making the grooves on the flange body face is not particularly critical so long as the grooves adequately reduces lateral gasket movement when sealed. Thus, depending upon the flange body material, the desired number and geometry of grooves may be machined onto the flange body face. Alternatively, the grooves may be molded into the flange body face. Advantageously, the grooves facilitate reduced abrasion and/or tearing of the gasket which increases gasket life and allows the system to maintain sealing performance over a longer period compared to a plain radius. The grooves also prevent and/or reduce the risk of allowing volatile gases contained within the tanks to escape at pressures below a relief set point since the seal is less likely to fail. The grooved system described above may be used in addition or as an alternative to the circumferential detents described above.

Figure 6A:
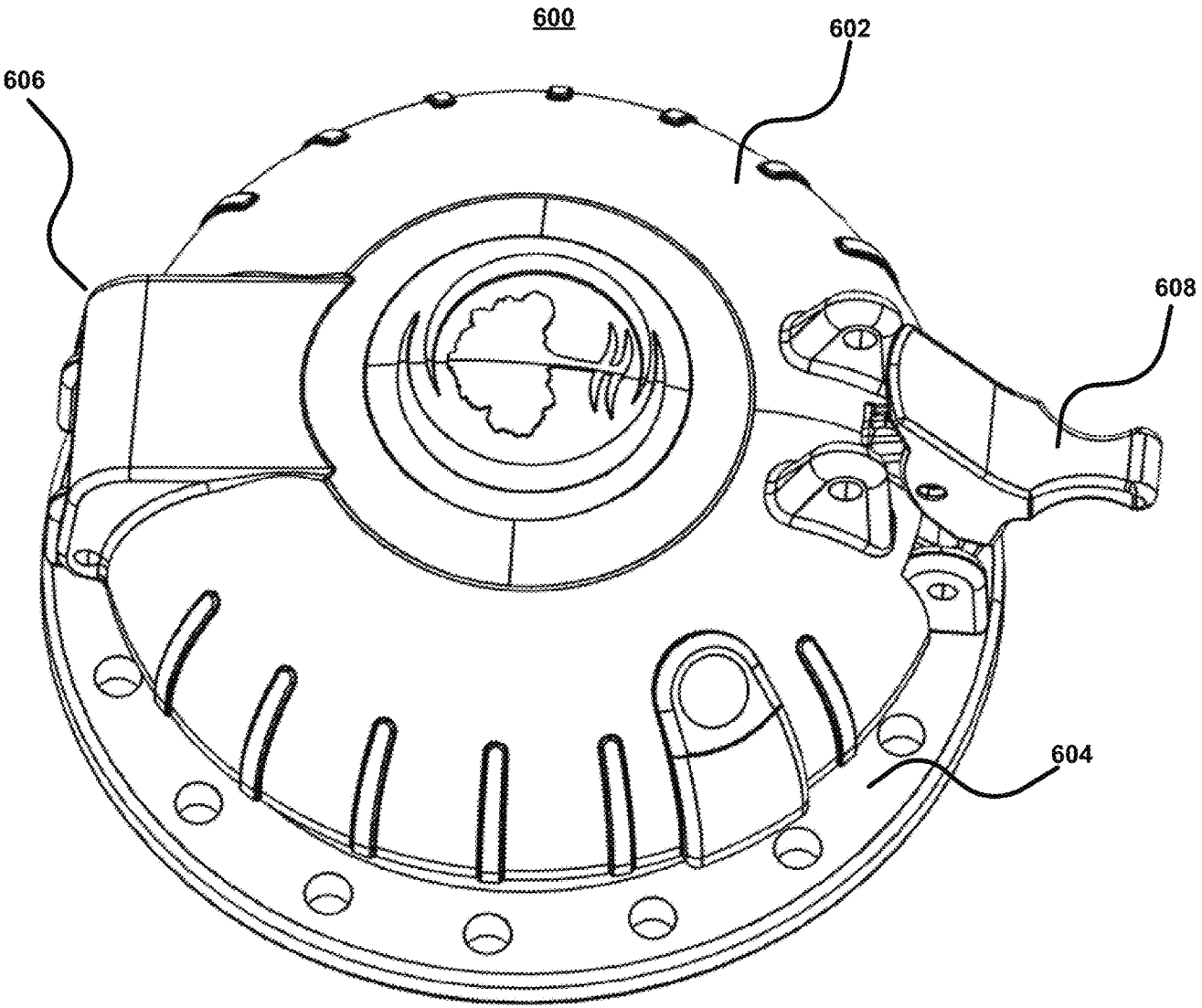
FIG. 6A is a top perspective view of a thief hatch unit according to exemplary embodiments.
Figure 6B:
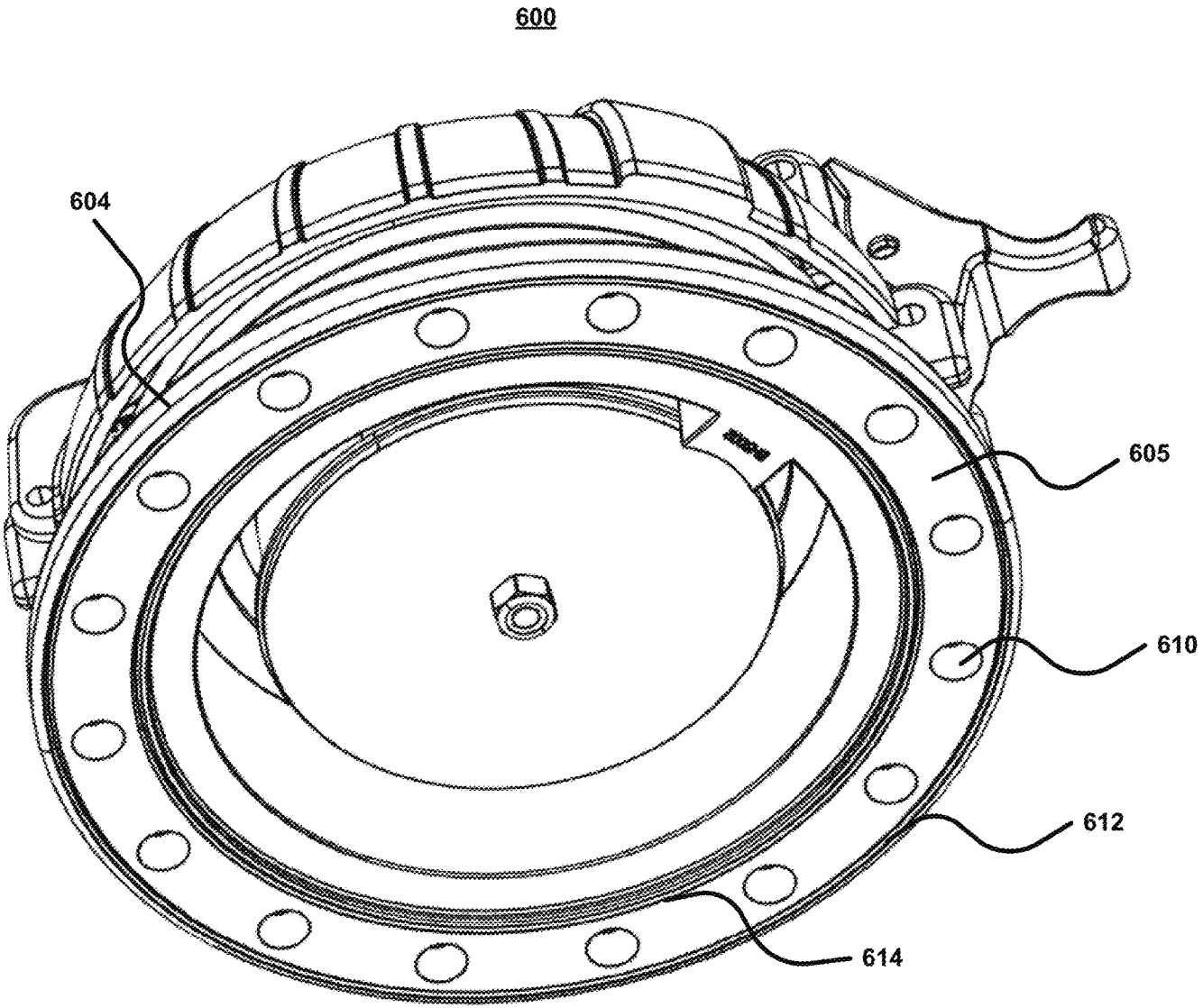
FIG. 6B is a bottom perspective view of the thief hatch unit according to exemplary embodiments.
Figure 6C:
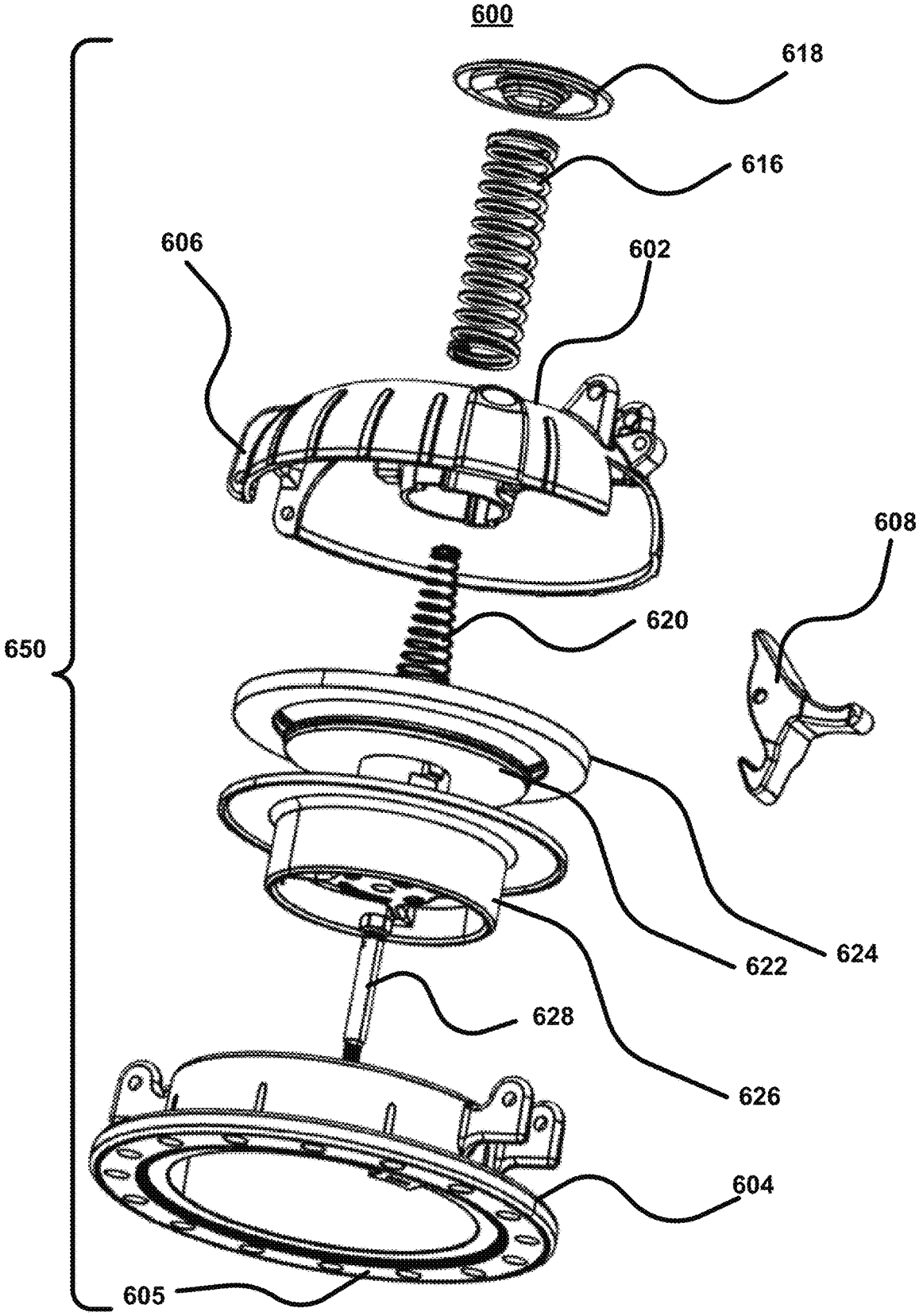
FIG. 6C is an exploded view of the thief hatch unit according to exemplary embodiments

FIG. 6 depicts a view of an exemplary thief hatch unit 600. Specifically, FIG. 6A is a top perspective view of thief hatch unit 600; FIG. 6B is a bottom perspective view of thief hatch unit 600; and FIG. 6C is an exploded view of thief hatch unit 600. As best seen in FIG. 6A, the thief hatch unit 600 has a lid 602, a flange body 604, a hinge 606, a latch mechanism 608. The materials used for each part are described above.

As best seen in FIG. 6B, the underside of the thief hatch unit 600 is depicted. This view depicts the underside 605 of the flange body 604; that is, the side that faces the tank and to which a gasket is mated. The flange body 604 has a plurality of bolt holes 610, and the above described circumferential detents which include outer detent 612 and inner detent 614. A gasket (not shown), such as that shown in FIG. 2, can be used and would be placed against the depicted side of the flange body 604 to rest in between the thief hatch unit 600 and the tank to which it is attached via bolts (not shown) placed into bolt holes 610. In various embodiments, the flange body 604 may have a surface such as that described above with respect to FIG. 3 or FIG. 5 or a combination thereof.

As best seen in FIG. 6C, the thief hatch unit may have a first spring 616 and a second spring 620. The first spring 616 may be a cylindrical spring and the second spring 620 may be a cone or conical spring. As described above, these may be the pressure and vacuum springs, respectively. The first spring 616 may surround the second spring 620. The lid 602 has a cap 618, which is located at a center top portion of the lid 602 and to which the pressure spring (616) abuts. The springs are attached to a platform 622. Platform 622 may have more than one part—in various embodiments, it may have a top and a bottom and a gasket located in-between and to seal with hollow gasket 624, inside of which it is located. The top and bottom may be aluminum or another suitable material and the gasket may be rubber or another suitable material. Below platform 622 and hollow gasket 624 is internal cap 626, and platform 622 is secured to internal cap 626 via bolt or locking pin 628, which is secured with a locking nut at its end. The internal cap 626 provides a seat for the springs and may have a hollow cylinder at the center of the internal cap. The combination of the springs, platform, hollow gasket, bolt, and internal cap may be referred to as an internal assembly. This internal assembly is part of the spring-actuated pressure relief mechanism.

Embodiments

1. A thief hatch comprising:

a flange body comprising a first polymer reinforced with glass wherein the flange is configured to attach to a tank roof;

a lid operably connected to the flange body wherein the lid comprises a second polymer reinforced with glass and wherein the lid comprises a spring-loaded hinge operably connected to allow for at least partial opening and closing of the lid;

a spring-actuated internal pressure relief device comprising a pressure and a vacuum spring and comprised of a composite, an aluminum, or combination thereof, wherein the spring-actuated internal pressure relief device is configured to allow for positive pressure relief, negative pressure relief, or both; and a gasket between the flange body and the lid and wherein the gasket comprises an elastomer and wherein the gasket is substantially concentric with the flange body;

wherein the first polymer and the second polymer are the same material or different materials.

2. The thief hatch of embodiment 1, wherein the flange body has a face facing the gasket wherein said flange body face facing the gasket comprises one or more grooves configured to reduce lateral movement of the gasket across said face.

3. The thief hatch of embodiment 1 or 2, wherein the flange body has a face facing the gasket wherein said flange body face facing the gasket comprises an outside circumferential groove and an inside circumferential groove that are configured to ensure substantial concentricity of the gasket with the flange body and are configured to mate with a corresponding outside circumferential detent and an inside circumferential detent on the gasket.

4. The thief hatch of embodiment 1 wherein the gasket comprises bolt holes around the circumference and wherein the top of the gasket comprises an outside circumferential detent and an inside circumferential detent.

5. The thief hatch of embodiment 4 wherein the outside circumferential detent and the inside circumferential detent are configured to ensure substantial concentricity of the gasket with the flange body.

6. The thief hatch of embodiment 1 which further comprises one or more sensors.

7. The thief hatch of embodiment 6 wherein the one or more sensors comprise a thermometer, a volatile organic compound detector, a lid closure sensor, or any combination thereof.

8. The thief hatch of embodiment 6 which further comprises a boss to hold the one or more sensors.

9. The thief hatch of embodiment 1 which further comprises one or more robots configured to adjust venting of one or more gases from the thief hatch.

10. The thief hatch of embodiment 1 wherein the first polymer, the second polymer, or both comprises a polyetherimide.

11. The thief hatch of embodiment 1 wherein the flange body comprising the first polymer reinforced with glass comprises from about 20% to about 40% by weight of glass based on the total weight of the first polymer and glass.

12. The thief hatch of embodiment 1 wherein the lid comprising the second polymer reinforced with glass comprises from about 20% to about 40% by weight of glass based on the total weight of the second polymer and glass.

13. The thief hatch of embodiment 1, wherein the pressure spring is a cylindrical spring and the vacuum spring is a conical spring and the vacuum spring is located inside of the pressure spring.

14. A thief hatch comprising:

a flange body comprising a first composite material wherein the flange is configured to attach to a tank roof; and a lid operably connected to the flange body wherein the lid comprises a second composite material and wherein the lid comprises a hinge operably connected to allow for at least partial opening and closing of the lid;

wherein the first composite material and the second composite material are the same material or different materials.

15. The thief hatch of embodiment 14, wherein the flange body comprises substantially no metal that is subject to corrosion.

16. The thief hatch of embodiment 14, wherein the lid comprises substantially no metal that is subject to corrosion.

17. The thief hatch of embodiment 14, wherein the first composite material, the second composite material, or both comprise a polymer.

18. The thief hatch of embodiment 14, wherein the first composite material, the second composite material, or both comprise a reinforced polymer.

19. The thief hatch of embodiment 17, wherein the polymer comprises a polyetherimide.

20. The thief hatch of embodiment 18, wherein the polymer comprises a polyetherimide.

21. The thief hatch of embodiment 14, wherein the thief hatch further comprises a gasket between the flange body and the lid and wherein the gasket is substantially concentric with the flange body.

22. The thief hatch of embodiment 21, wherein the gasket comprises bolt holes around the circumference and wherein the top of the gasket comprises an outside circumferential detent and an inside circumferential detent.

23. The thief hatch of embodiment 22, wherein the outside circumferential detent and the inside circumferential detent are configured to ensure substantial concentricity of the gasket with the flange body.

24. The thief hatch of embodiment 14, wherein the flange body has a face facing the gasket wherein said flange body face facing the gasket comprises one or more grooves configured to reduce lateral movement of the gasket across said face.

25. The thief hatch of embodiment 14 or 24, wherein the flange body has a face facing the gasket wherein said flange body face facing the gasket comprises an outside circumferential groove and an inside circumferential groove that are configured to ensure substantial concentricity of the gasket with the flange body and are configured to mate with a corresponding outside circumferential detent and an inside circumferential detent on the gasket.

In the preceding specification, various embodiments have been described with references to the accompanying drawings. It will, however, be evident that various modifications and changes may be made thereto, and additional embodiments may be implemented, without departing from the broader scope of the invention as set forth in the claims that follow. The specification and drawings are accordingly to be regarded as an illustrative rather than restrictive sense.

We claim:

1. A thief hatch comprising:

a flange body comprising a first polymer reinforced with glass wherein the flange body is configured to attach to a tank roof;

a lid operably connected to the flange body wherein the lid comprises a second polymer reinforced with glass;

a spring-actuated pressure relief mechanism, comprising a pressure and a vacuum spring, operably connected to the lid and an internal assembly to allow for at least partial opening and closing of the lid and configured to act as an internal pressure relief device wherein the internal pressure relief device is configured to allow for positive pressure relief, negative pressure relief, or both; and a gasket between the flange body and the lid and wherein the gasket comprises an elastomer and wherein the gasket is substantially concentric with the flange body;

wherein the first polymer and the second polymer are the same material or different materials; and wherein the flange body has a face facing the gasket wherein said flange body face comprises one or more grooves configured to reduce lateral movement of the gasket across said face.

2. The thief hatch of claim 1 wherein the gasket comprises bolt holes around the circumference and wherein the top of the gasket comprises an outside circumferential detent and an inside circumferential detent.

3. The thief hatch of claim 2 wherein the outside circumferential detent and the inside circumferential detent are configured to ensure substantial concentricity of the gasket with the flange body.

4. The thief hatch of claim 1 which further comprises one or more sensors.

5. The thief hatch of claim 4 wherein the one or more sensors comprise a thermometer, a volatile organic compound detector, a lid closure sensor, or any combination thereof.

6. The thief hatch of claim 4 which further comprises a boss to hold the one or more sensors.

7. The thief hatch of claim 1, wherein the pressure spring is a cylindrical spring and the vacuum spring is a conical spring and the vacuum spring is located inside of the pressure spring.

8. The thief hatch of claim 1 wherein the first polymer, the second polymer, or both comprises a polyetherimide.

9. The thief hatch of claim 1 wherein the flange body comprising the first polymer reinforced with glass comprises from about 20% to about 40% by weight of glass based on the total weight of the first polymer and glass.

10. The thief hatch of claim 1 wherein the lid comprising the second polymer reinforced with glass comprises from about 20% to about 40% by weight of glass based on the total weight of the second polymer and glass.

11. The thief hatch of claim 1 wherein the flange body comprises bolt holes around the circumference.

12. A thief hatch comprising:

a flange body comprising a first composite material wherein the flange is configured to attach to a tank roof; and a lid operably connected to the flange body wherein the lid comprises a second composite material and wherein the lid comprises a hinge mechanism;

a spring-actuated pressure relief mechanism comprising two springs and operably connected between the lid and an internal assembly;

wherein the first composite material and the second composite material are the same material or different materials, and wherein the flange body has a face for accepting a gasket and wherein said flange body face comprises one or more grooves configured to reduce lateral movement of the gasket across said face.

13. The thief hatch of claim 12, wherein the flange body comprises substantially no metal that is subject to corrosion.

14. The thief hatch of claim 12, wherein the lid comprises substantially no metal that is subject to corrosion.

15. The thief hatch of claim 12, wherein the first composite material, the second composite material, or both comprise a polymer.

16. The thief hatch of claim 12, wherein the first composite material, the second composite material, or both comprise a reinforced polymer.

17. The thief hatch of claim 15, wherein the polymer comprises a polyetherimide.

18. The thief hatch of claim 16, wherein the reinforced polymer comprises a polyetherimide.

19. The thief hatch of claim 12, wherein the thief hatch further comprises a gasket between the flange body and the lid and wherein the gasket is substantially concentric with the flange body and wherein the flange body has a face facing the gasket wherein said flange body face facing the gasket comprises one or more grooves configured to reduce lateral movement of the gasket across said face.

20. The thief hatch of claim 12, wherein the thief hatch further comprises a gasket between the flange body and the lid and wherein the gasket is substantially concentric with the flange body wherein the gasket comprises bolt holes around the circumference and wherein the top of the gasket comprises an outside circumferential detent and an inside circumferential detent.

21. The thief hatch of claim 20 wherein the outside circumferential detent and the inside circumferential detent are configured to ensure substantial concentricity of the gasket with the flange body and the outside circumferential detent and the inside circumferential detent are configured to mate with corresponding grooves on the flange body.

* * * * *